United States Patent [19]

Aschenbrenner et al.

[11] 4,170,866

[45] Oct. 16, 1979

[54] PROCESS AND APPARATUS FOR PRODUCING OPEN-END SPUN YARN

[76] Inventors: Frank A. Aschenbrenner, RR#13, Box 489, Muncie, Ind. 47307; William V. Wright, 2412 Cloister Dr., Charlotte, N.C. 28211

[21] Appl. No.: 929,661

[22] Filed: Jul. 31, 1978

[51] Int. Cl.[2] ..... D01H 1/12

[52] U.S. Cl. ..... 57/58.95; 57/58.89

[58] Field of Search ..... 57/58.89, 58.95, 156, 57/5

[56] References Cited

U.S. PATENT DOCUMENTS

| | | | |
|---|---|---|---|
| 3,411,284 | 11/1968 | Corbaz et al. | 57/58.91 |
| 3,537,249 | 11/1970 | Mayer, Jr. | 57/58.89 |
| 3,665,695 | 5/1972 | Amato | 57/58.91 |
| 3,673,781 | 7/1972 | Breitenbach | 57/58.89 |
| 3,797,218 | 3/1974 | Landwehrkamp et al. | 57/58.95 X |
| 3,845,611 | 11/1974 | Senturk et al. | 57/5 |
| 3,901,012 | 8/1975 | Safar | 57/58.89 |
| 3,945,185 | 3/1976 | Nakamura et al. | 57/58.91 X |
| 4,028,871 | 6/1977 | Aschenbrenner | 57/58.89 |
| 4,040,243 | 8/1977 | Weller, Jr. | 57/58.95 X |

*Primary Examiner*—John Petrakes

*Attorney, Agent, or Firm*—Richards, Shefte & Pinckney

[57] ABSTRACT

A process and apparatus for producing open-end spun yarn using an electrostatic field produced by a pair of spaced electrodes in combination with a spinning rotor having an acutely inclined circumferential wall and a circumferential groove at the junction between the inner surface of the rotor wall and the planar surface of the rotor. Staple fibers are fed to the electrostatic field where they are generally linearly oriented and straightened and from which the fibers are aerodynamically withdrawn and fed onto the inner surface of the inclined rotor wall by means of a feed passageway tangentially oriented to the inclined rotor wall and having a gradually decreasing cross-sectional area so as to impose upon the fibers fed therethrough an ever-increasing velocity. The fibers centrifugally progress along the inner surface of the inclined rotor wall and gather in the circumferential rotor groove at which point the fibers begin to combine through cohesion both with other fibers in the groove and with the fibers in the tail of the yarn which is being twisted and withdrawn from the rotor, thereby forming a strand of fibers cohering to the tail of yarn previously formed. The formed yarn is continuously withdrawn, the continuous rotation of the rotor causing the tail of the yarn being withdrawn to be continuously swept along the inner circumference of the rotor thereby imparting twist to the strand of fibers at the tail, and also effecting the addition through cohesion of new fibers to the tail from the circumferential groove.

24 Claims, 8 Drawing Figures

PROCESS AND APPARATUS FOR PRODUCING OPEN-END SPUN YARN

BACKGROUND OF THE INVENTION

This invention relates to the open-end spinning of yarn, and more particularly to the spinning of yarn using a rotary spinning unit which collects and joins the fibers for twisting into a spun yarn.

The use of a rotating rotor in open-end spinning is generally known to the art. In a typical prior art operation, staple fibers are continuously aerodynamically fed to a rotating spinning rotor where in they are subjected to centrifugal force created by the rotation thereof, causing the fibers to progress outwardly to a point at which the fibers gather, the gathered fibers being continuously withdrawn and twisted to form a spun yarn. Among the advantages of such a spinning operation are increased productivity, decreased labor costs and the potential reduction of power costs. However rotor open-end spinning is subject to several disadvantages, a major disadvantage being the relatively low tensile strength in comparison with conventional ring spun yarn. The decrease in tensile strength stems from the random orientation and the bridging of fibers inherently occurring in rotor open-end spinning resulting in a significant loss of effective fiber length contribution to yarn strength. The most widely used fiber feeding means has been a licker-in disposed to feed the fibers to the rotor unit. The licker-in opens the fibers and partially aligns them through its combing action, but in doing so the toothed wheel of a licker-in itself causes hooks on the ends of fibers which are not straightened prior to the spinning operation, and as a result there has been limited commercial usage of open-end spinning of this sort.

Another significant disadvantage of rotary open-end spinning is the vulnerability of such apparatus to dirt and debris. Fibers fed into the rotor must be very clean because trash entering the rotor will centrifugally travel to and collect at the outer point at which the fibers gather, causing unevenness in the yarn produced and resulting in a higher number of ends down.

Typically, known open-end spinning devices rely solely on the application of aerodynamic forces to accomplish fiber feeding, orienting and aligning in delivering fibers to the rotor, resulting in the aforementioned disadvantages. In an attempt to avoid the problems of aerodynamic systems, Breitenbach U.S. Pat. No. 3,673,781, issued July 4, 1972, discloses the use of an electrostatic field and minimized aerodynamic forces, with the rotor serving as one of the electrodes, but such an arrangement sacrifices the straightening, orienting and aligning advantages of aerodynamic systems in attempting to minimizing the disadvantages.

In another form of known spinning, a core yarn is run through a fiber feeding device and is twisted to form a core yarn. Examples of such core spinning are disclosed in Senturk and Aschenbrenner U.S. Pat. No. 3,845,611, issued Nov. 5, 1974 and Aschenbrenner U.S. Pat. No. 4,028,871, issued June 14, 1977. In these devices electrostatic forces are utilized to straighten and align fibers for effective orientation for deposit on and twisting with a core yarn. These devices do not involve rotor spinning or aerodynamic feeding, however, although Aschenbrenner U.S. Pat. No. 4,028,871 has been known to produce commercially orienting and straightening forces acting on the fibers.

In contrast to the use in the prior art of either electrostatic or aerodynamic forces on a mutually exclusive basis, the present invention combines aerodynamic and electrostatic forces in a unique manner to achieve a commercially acceptable spun yarn of comparable or better quality than conventional ring spun yarns. This is done using electrostatic field producing apparatus, in one embodiment this is the same type apparatus as disclosed in Aschenbrenner U.S. Pat. No. 4,028,871, employed to provide initial straightening and aligning of staple fibers and, in the one embodiment, a final fiber-cleaning step prior to spinning. In this manner, effective fiber length contribution to yarn strength is made possible, a result which does not occur when licker-ins are normally employed with rotary units. The electrostatic force is combined with aerodynamic force that is applied to aerodynamically withdraw the fibers from the electrostatic field and aerodynamically feed them to the rotating spinning rotor at an ever-increasing velocity so that the straightening and linear alignment achieved by the electrostatic field is not only maintained but enhanced. Means are also provided to prevent any fiber distorting decrease in the velocity of the fibers upon entering the rotor chamber. Fibers are therefore deposited onto the rotor surface, which is rotated at a greater surface speed than the fibers being fed thereto, in a straightened and aligned disposition and are centrifugally gathered and combined for twisting and withdrawing therefrom as a spun yarn. In this manner, a high quality uniform spun yarn is produced having a consistently higher average tensile strength than conventional ring spun yarn.

SUMMARY OF THE INVENTION

The present invention provides a process and apparatus for producing open-end spun yarn from staple fibers using an electrostatic field and a spinning rotor wherein staple fibers are continuously fed to an electrostatic field in which the fibers are straightened and generally linearly oriented and from which they are aerodynamically withdrawn and fed into a rotor chamber in an adjacent body, wherein a spinning rotor centrifugally combines the fibers for subsequent twisting and withdrawing in the form of a spun yarn.

In one form of the invention the electrostatic field is formed with a zone of increased field intensity to which the fibers migrate in the field and in which the fibers are generally linearly oriented and straightened.

Preferably, suction is provided to accomplish the aerodynamic withdrawing and feeding of the fibers to the spinning rotor, and the aerodynamic feeding is facilitated by directing the suction through a passageway opening at one end thereof generally adjacent the electrostatic field and opening at the other end thereof into the chamber housing the spinning rotor, the passageway having a gradually decreasing cross-sectional area in the direction of feed whereby fibers withdrawn from the field are delivered to the spinning rotor at an ever increasing velocity.

Also preferably, the rotor is constructed with an acutely inclined circumferential wall for receiving on the inner surface thereof fibers withdrawn and fed from the electrostatic field with the inclined wall causing the fibers to progress centrifugally therealong and combine to form a strand, which is withdrawn in twisted form as a spun yarn.

In the preferred embodiment, the body housing the spinning rotor is provided with a cylindrical portion which projects into the rotor chamber and has a circular cross-sectional area slightly less than the circular area defined by the rim of the spinning rotor, the rotor being positioned within the chamber such that the rim thereof substantially surrounds the cylindrical projecting portion in a manner so as to create both a small circular gap between the cylindrical projecting portion and the rotor rim, and a small gap between the rotor rim and the chamber surface from which the cylindrical portion projects, thereby substantially enclosing the actual spinning area within the rotor. The feed passageway passes through the body housing the rotor and through the cylindrical projecting portion in a manner such that the passageway is generally tangential to the inclined wall of the rotor, the end of the passageway opening into the rotor chamber being generally adjacent to the upper portion of the inclined wall. Integrally related to the two previous features is another feature providing for rotation of the rotor at a speed whereby the fiber receiving surface speed thereof is greater than the velocity at which fibers are fed thereonto. In this manner, fibers exit the feed passageway in a straightened and aligned disposition generally tangentially to the inner surface of the inclined rotor wall and are immediately caught in a circumferentially circulating airstream created by circulation of air sucked into the rotor chamber in feeding fibers thereto, this circulating airstream being produced by the greater rotational speed of the rotor and the substantially enclosed nature of the spinning area within the rotor. Thus, the fibers exiting from the passageway experience no fiber distorting decrease in velocity and are immediately deposited substantially tangentially onto the inner surface of the inclined rotor wall in a straightened, aligned and extended disposition.

Further, the combined electrostatic and aerodynamic spinning system includes means at a point removed from the aforementioned linear zone of increased field intensity for collecting fly and other waste material entering the electrostatic field which are not collected at the linear zone and are not withdrawn therefrom.

DESCRIPTION OF THE PREFERRED EMBODIMENTS

In the embodiment of the present invention illustrated in FIGS. 1–6 of the accompanying drawings, the process and apparatus are shown producing a spun yarn in which staple fibers are straightened, aligned and collected by an electrostatic field, aerodynamically withdrawn therefrom and fed to a rotating spinning rotor which centrifugally combines the fibers into a strand, the strand being twisted and withdrawn from the rotor to form the spun yarn.

Figure 1:
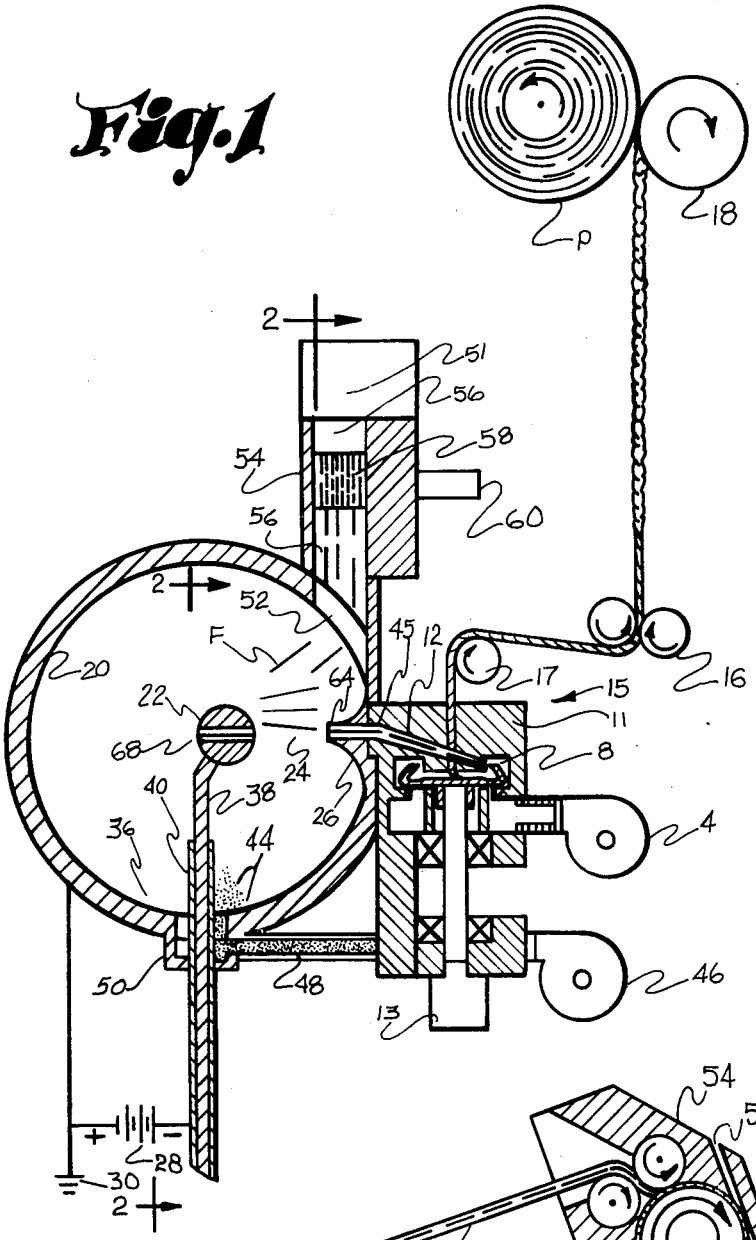
FIG. 1 is a partially schematic vertical sectional view of an apparatus according to the preferred embodiment of the present invention.
Figure 2:
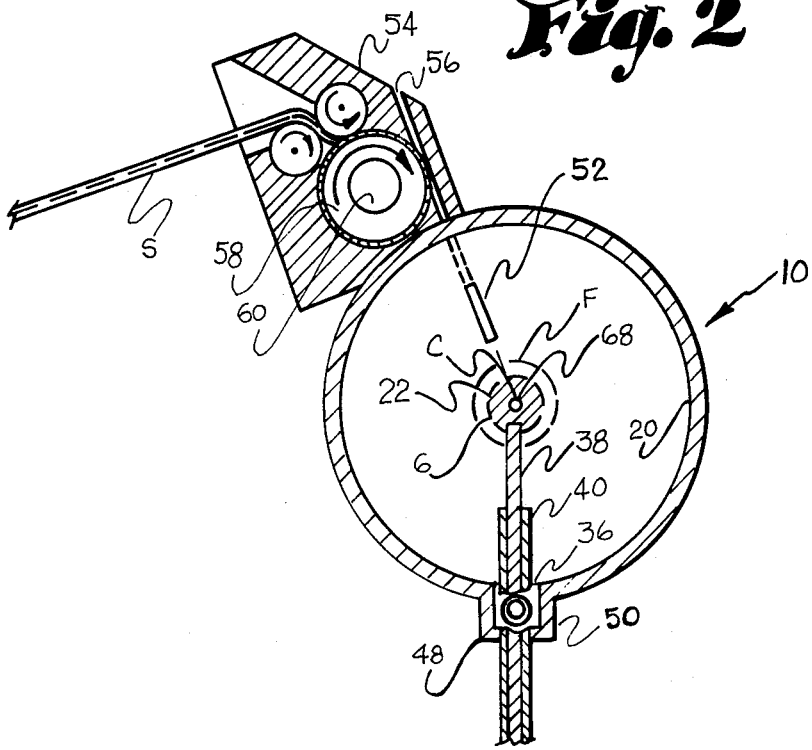
FIG. 2 is a vertical sectional view of the apparatus of FIG. 1 taken along line 2—2 of FIG. 1.
Figure 3:
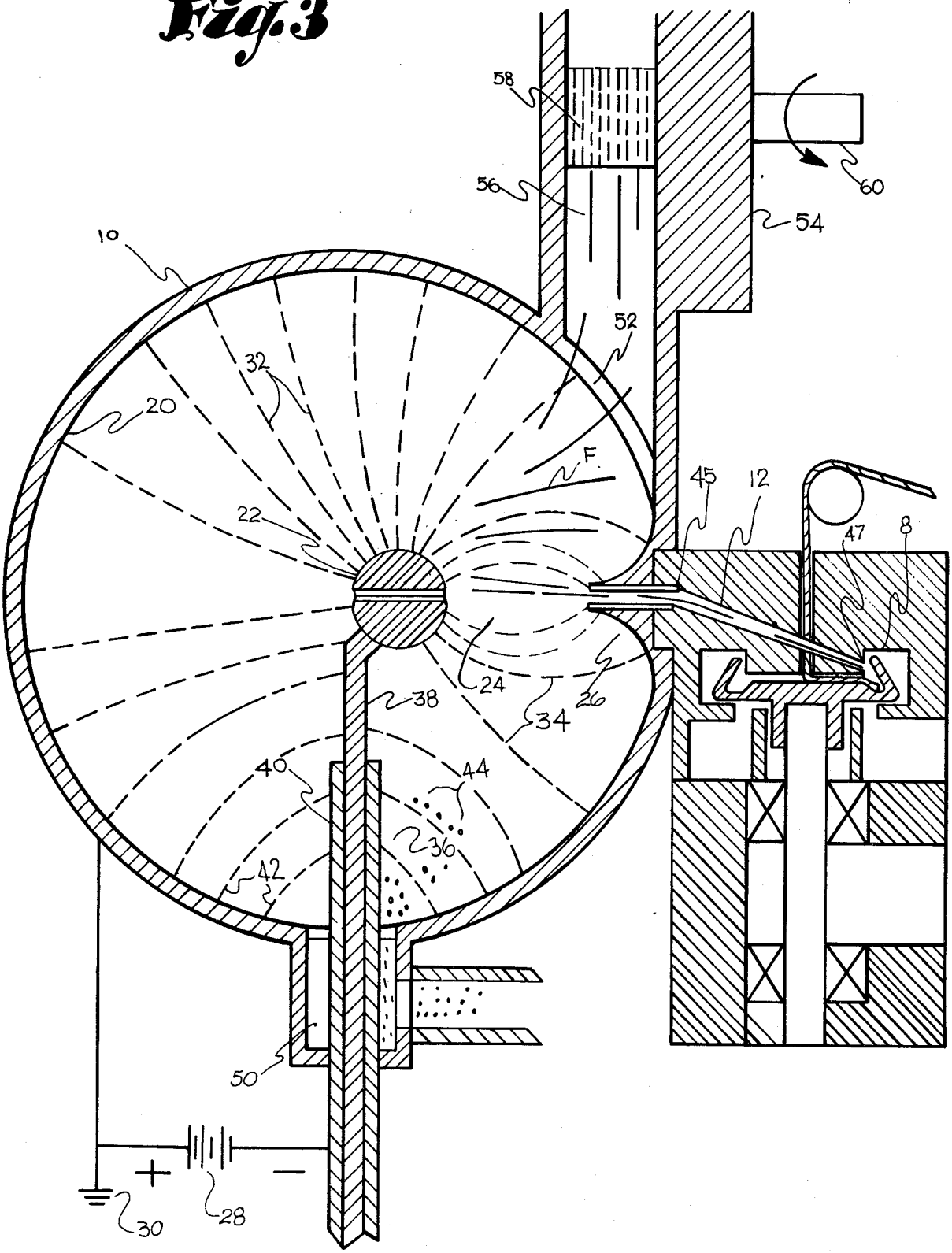
FIG. 3 is an enlargement of the central portion of FIG. 1, including a diagrammatic illustration of the lines of force of electrostatic field intensity and a cross section of the rotor unit.

Referring first to FIGS. 1–3, an electrostatic field producing apparatus 10 is illustrated, being of the same general construction, form and function described and illustrated in Aschenbrenner U.S. Pat. No. 4,028,871, the disclosure of which is incorporated herein by reference. The electrostatic field used to align, straighten and collect fibers F for feeding to the rotary spinning unit 15 is produced by means that includes an outer electrode 20 and an inner electrode 22. The outer electrode 20 is generally spherical, hollow and relatively large and the inner electrode 22 is spherical, relatively small, and disposed asymmetrically within the outer electrode 20, the asymmetrical placement being provided by offsetting the inner electrode 22 horizontally from the center of the outer electrode 20 resulting in a decreasing spacing between the electrodes toward a linear zone 24 of reduced spacing. The decreased spacing is accentuated immediately adjacent the linear zone 24 by an inwardly curved tapering of the interior of the outer electrode 20 as indicated at 26. With this arrangement, when an electrical potential is imposed between the electrodes, an electrostatic field is produced in the spherical interior of the outer electrode 20 between the inner electrode 22 and the outer electrode 20, the decreasing spacing therebetween resulting in a variation of the intensity of the electrostatic field, the intensity increasing as the spacing between the electrodes decreases and being the greatest at the linear zone 24 due to the sharply reduced spacing produced by the inner taper 26 of the outer electrode 20.

A secondary zone 36 of increased field intensity in the lower portion of the spherical electrostatic field is also created, the secondary zone 36 being created by the decreased spacing between the outer electrode 20 and a lead rod or element 38 which functions both as a support for the inner electrode 22, and as the means for connecting the inner electrode 22 with the source of electrical potential 28. A sheath of electrical insulating material encases the rod 38 a portion of the distance into the outer electrode 20 and exteriorly thereof to prevent electrical sparking therebetween. This arrangement produces a secondary area of reduced spacing thereby producing a corresponding increasing field intensity at the bottom of the outer electrode 20. This secondary zone 36 collects fly and other waste material within the spherical outer electrode 20 which have passed by gravity, suction or otherwise past the linear zone 24 of increased field intensity. Such fly and other waste material can thus be removed from within the electrostatic field by suction applied from any conventional source, schematically indicated by numeral 46, through a suction conduit 48.

Staple fibers F are fed into the electrostatic zone through a small narrow opening 52 in the outer spherical electrode 20 above the primary zone 24 of increased field intensity. The feeding of fibers F is accomplished by means mounted in a housing 54 which constitutes an upward extension of the outer electrode 20 that forms a passageway 56 leading to the opening 52 and in which passageway 56 a conventional opening device, such as a licker-in 58, is mounted and driven in any conventional means through a shaft 60. Licker-in 58 separates staple fibers F from a sliver S fed into the passageway 56 through the opening 51 on the surface of housing 54 and dispenses the fibers F in separate form into the passageway 56 for discharge through the opening 52 into the electrostatic field within the outer electrode 20 for migration to the linear zone 24 of increased field intensity. As the opening 52 is the only significant opening through which air can enter the interior of the outer electrode 20, the aforementioned suction imposed through the suction conduit 48 is concentrated at the opening 52 and, therefore, in the passageway 56, thereby serving as means for drawing the fibers F downwardly through the passageway 56 and opening 52 into the electrostatic field. To minimize the effect of the opening 52 as an absence of electrode surface area, it is formed relatively narrow and parallel with the primary zone 24 of increased field intensity. However, the size and shape of this opening 52 may be varied as desired to obtain suitable results.

An opening 64 is provided in the outer electrode 20 at the point at which the inner taper 26 of the outer electrode 20 is greatest to provide for the withdrawing of fibers from the electrostatic field and feeding thereof to the rotary spinning unit, as explained more fully below. A more detailed description of the structure and operation of the electrostatic field creating apparatus may be found in Aschenbrenner U.S. Pat. No. 4,028,871.

The rotary spinning unit which combines the electrostatic straightened and aligned fibers into a strand for twisting into a spun yarn is indicated generally at 15. The rotor unit 15 is connected to the electrostatic field producing apparatus 10 and includes an outer shell or body 11 disposed adjacent the linear zone 24 and within which is formed a rotor chamber 8, the body 11 having a cylindrical portion 9 which projects into the chamber 8. Disposed within the chamber 8 for rotation therewithin is a spinning rotor 32 provided with a circumferential wall 34 having an inner surface 53 for receipt of fibers thereon and being inclined toward the axis of rotation of the rotor 32 so as to form an acute angle between the wall 34 and the planar surface 35 of the rotor 32. A circumferential groove 37 is formed on the inner surface of the rotor 32 facing the axis of rotation thereof at the junction of the rotor planar surface 35 and the rotor wall 34, groove 37 representing the outermost point of the inner surface of the rotor 32.

Figure 4:
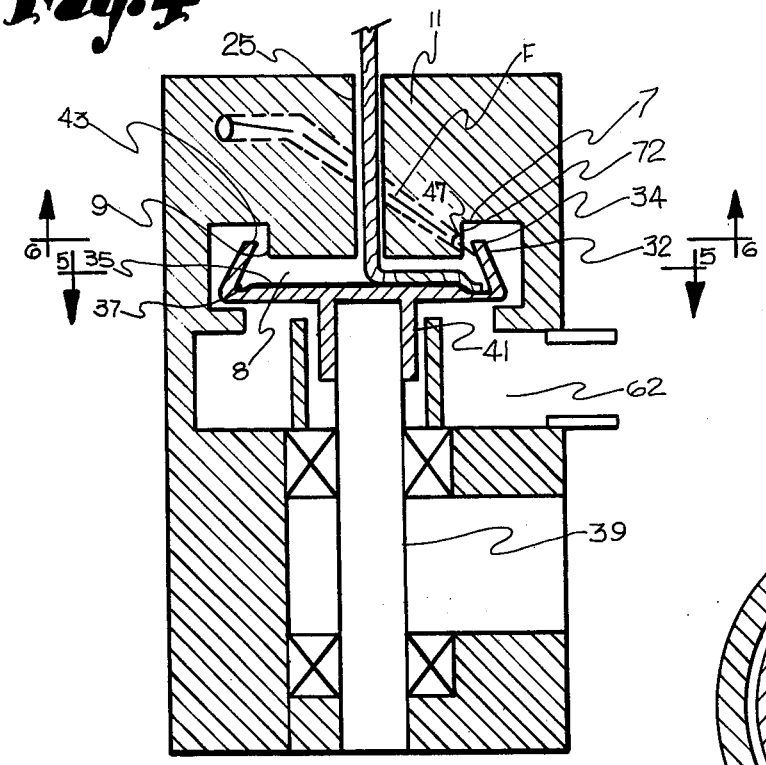
FIG. 4 is an enlarged cross section of the rotor unit of the preceding figures.

The aforementioned cylindrical projecting portion 9 is constructed so as to have a circular cross-sectional area only slightly smaller than the circular area defined by the rim 43 of the rotor wall 34 such that when the rotor 32 is positioned within the chamber 8, the rotor wall 34 substantially encircles the cylindrical projecting portion 9 leaving small airspaces both between the rim 43 of the rotor wall 34 and the cylindrical projecting portion 9, and between the rim 43 and the surface 7 of the chamber 8 from which the cylindrical projecting portion 9 extends, all as shown in FIG. 4.

Attached to rotor unit 15 is conventional means for rotational driving of rotor 32, such as an electric motor, indicated schematically at 13 and having a drive shaft 39 extending therefrom into the chamber 8 and being fixedly inserted into a hub 41 projecting from the outer planar surface of rotor 32.

Also formed within the body 11 is a linear passageway 12 for delivering fibers from the linear zone 24 of increased field intensity in the electrostatic field to the spinning rotor 32, the passageway 12 being formed within the body 11 and extending from a point adjacent the opening 64 through the body 11 and through the cylindrical projecting portion 9 to the rotor chamber 8 in generally tangential relation to the rotor wall 34 as shown in FIG. 4. The entrance opening 45 of the passageway 12 communicates directly with the opening 64 of the outer electrode 20 the entrance portion of the passageway 12 beng colinear with the linear zone 24. The exit opening 47 of the passageway 12 is located on the surface of the cylindrical projecting portion 9 immediately adjacent the upper inner surface of the rotor wall 34, the passageway 12 having a gradually decreasing cross-sectional area in the direction of fiber feed.

Attached to the body 11 and communicating with the chamber 8 is a secondary suctin unit 4 of conventional construction which serves to create a moving carrying airstream through the chamber 8 and passageway 12 to withdraw fibers from the linear zone 24 of increased field intensity into the passageway 12 and carry them through the passageway 12 for delivery onto the upper inner surface of the rotor wall 34.

Finally a tubular passage 25 is provided in the body 11 coaxial with the axis of rotation of the rotor 32 for withdrawing the strand of collected fibers from the circumferential groove 37 of the rotor 32. Strand withdrawal from the rotor 32 and final twisting thereof into a spun yarn are effected in a known manner by rotation of a guide roller 17 and a pair of take-up rollers 16, the yarn being wound on a storage package P that is rotated by a surface contacting roll 18.

The operation of the above described structure is as follows. Initially the source 28 of electrical potential must be energized, as must be the rotor 32, both suction means 4 and 46, take-up rollers 16, and licker-in 58. A sliver S may then be fed to the licker-in 58, which separates the sliver S into individual fibers F which are drawn into the electrostatic field through the opening 52 by the suction created by the suction means 46. Fibers entering the electrostatic field are electrostatically migrated toward the linear zone 24 of increased field intensity under the influence of the increasing electrostatic field intensity. The taper 26 causes a rapid increase in field intensity at the linear zone 24, thereby causing a rapid final migration of fibers F to the linear zone 24 resulting in the straightening of fibers F and the linear orientation thereof in horizontal disposition in linear zone 24. At this point, fibers F become influenced by suction created by the suction means 4 and directed through the passageway 12, effecting the withdrawal of the straightened and linearly oriented fibers F from the linear zone 24 through the opening 64 and entry thereof into the passageway 12.

The decreasing cross-sectional area of the passageway 12 effects a constant increase in the velocity of the moving carrying airstream created by the suction means 4 and a resultant constant increase in the velocity at which fibers F travel through the passageway 12. In this manner, a larger force acts on the leading end of each of the fibers F than acts on the trailing end, therefore tending to straighten the fibers F and maintain and enhance the linear alignment thereof achieved by the electrostatic field. Such acceleration of fibers F is desirable at every stage of fiber transport until arrival on the collecting surface of the rotor 32 in order to achieve maximum linear alignment and straightening of the fibers. Therefore, in order to maintain fiber acceleration at every stage of fiber transport and prevent any fiber distorting decrease in fiber velocity upon exit of the fibers from the passageway 12, the body 11 is formed with the cylindrical projecting portion 9 extending into the chamber 8, the rotor 32 being positioned in the chamber 8 such that the inclined rotor wall 34 substantially and closely encircles the cylindrical projecting portion 9, and the passageway 12 is oriented within the body 11 and within the cylindrical projecting portion 9 generally tangentially to the inclined rotor wall 34 and opening into the chamber 8 on the surface of the cylindrical projecting portion 9 adjacent the upper inner surface of the inclined rotor wall 34, all as set forth more fully above. Finally rotor 32 is rotated by the motor 13 at a speed sufficient to achieve a rotor wall surface speed greater than the velocity at which fibers F exit the passageway 12. The greater circumferential speed of the rotor 32 in conjunction with the disposition thereof so as to closely surround the cylindrical projecting portion 9 and thereby substantially enclose the actual spinning area within rotor 32 serve to prevent the immediate escape of air sucked into the rotor 32 in feeding fibers F thereto by encouraging the circumferential circulation of such air within rotor 32 itself. In this manner, the moving carrying airstream is circumferentially circulated within the substantially enclosed rotor spinning area, preventing any decrease in the velocity of fibers exiting the passageway 12, and maintaining and further enhancing the linear alignment and straightened disposition of fibers previously placed on the rotor wall 34, the air gradually escaping over the rim 43 of the rotor 32 as it is circulated. Therefore, fibers F exit the passageway 12 in straightened and aligned disposition generally tangentially to the inclined rotor wall 34 and are immediately simultaneously caught in the circumferentially circulating airstream within the rotor 32 and deposited against the upper inner surface of the inclined rotor wall 34 in substantially tangential relation thereto without any impairment or loss of the straightened and aligned disposition of the fibers. The greater speed of rotor 32 serves to frictionally pull the fibers against the receiving surface thereof thereby additionally serving to preserve the stretched out condition of the fibers F.

Figure 5:
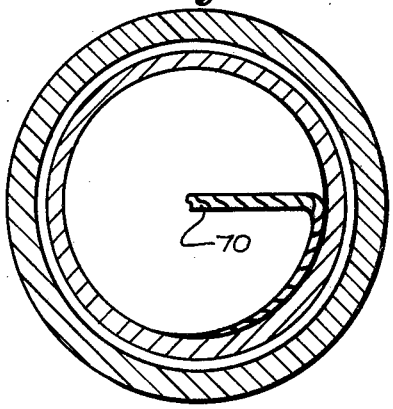
FIG. 5 is a horizontal sectional view of the rotor unit of FIG. 4 suction along line 5—5 of FIG. 4.
Figure 6:
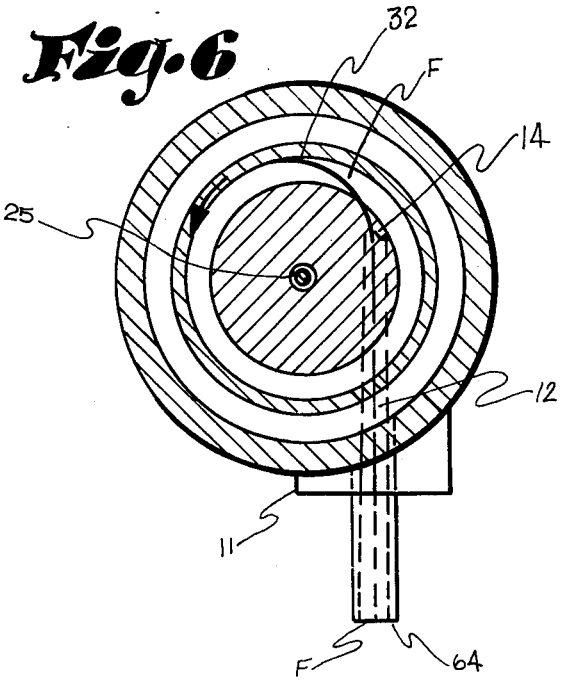
FIG. 6 is a horizontal sectional view of the rotor unit of FIG. 4 taken along line 6—6 of FIG. 4.

Once fibers F are deposited onto the upper inner surface of the inclined rotor wall 34, they immediately become subjected to the centrifugal force created by the rotation of the rotor 32 and, under the influence of this force, the fibers gradually travel outwardly on the inclined rotor wall 32 toward the circumferential groove 37. The fibers collect in the groove 37 where they join through cohesion not only with other fibers in the groove 37 but also with the fibers in the tail of the yarn being withdrawn through the tube 25, thereby forming a strand of fibers cohering to the tail of the yarn previously formed. The continuously growing strand is continuously withdrawn radially from the rotor 32 through the tube 25, as shown in FIG. 5, the radial portion 70 of the strand and the circumferential tail 66 thereof being continuously rotated by the rotor 32 causing the tail 66 to continuously sweep along the inner circumference of the rotor 32 thereby imparting twist to the strand to form a spun yarn, and also effecting the addition through cohesion, of new fibers to the tail 66 from the groove 37. The twisted yarn is withdrawn vertically through the tube 25 and passes over the guide roller 17 and take-up rollers 16 causing a final insertion of twist prior to the winding of the spun yarn onto the package P through the rotation of the surface contacting roller 18.

Figure 7:
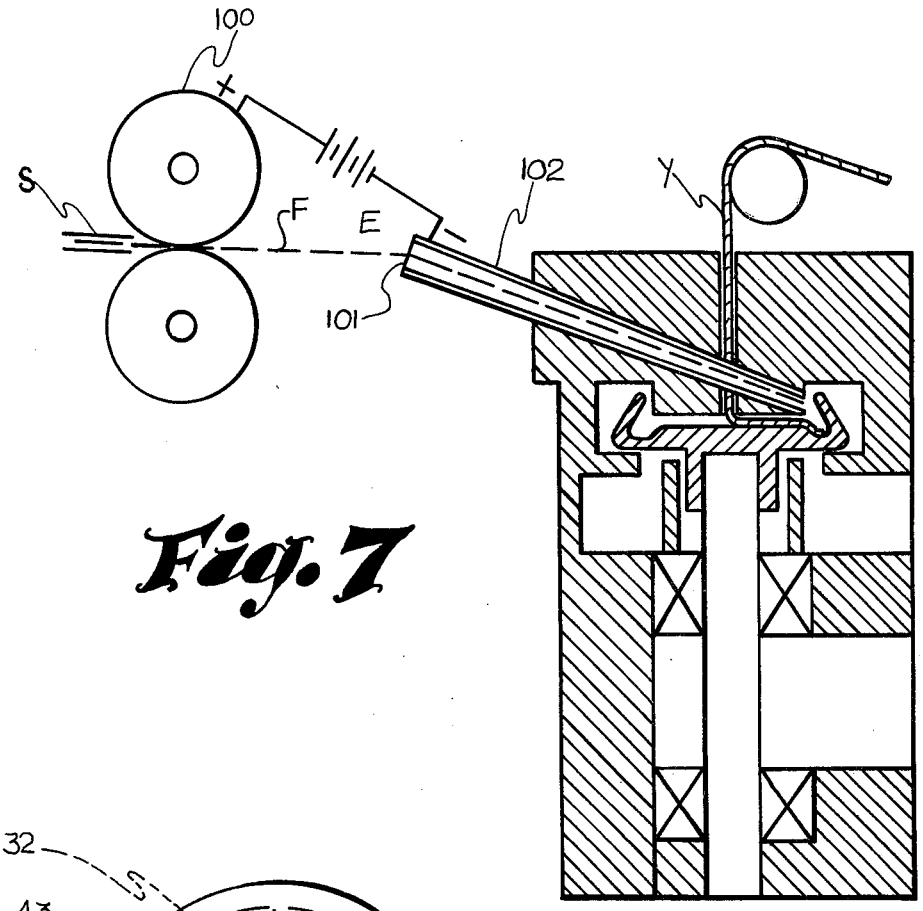
FIG. 7 is a view similar to FIG. 3 illustrating a simplified embodiment of the present invention.
Figure 8:
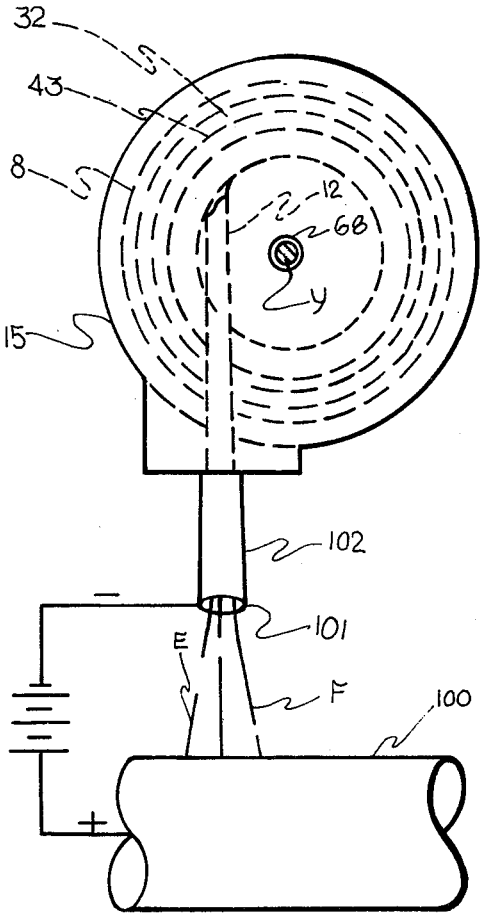
FIG. 8 is a plan view of the embodiment of FIG. 7.

The embodiment of the foregoing description, as illustrated in FIGS. 1–6, incorporates all of the features and advantages of the present invention. However, satisfactory results have also been obtained with a simplified electrostatic field system, such as is illustrated in FIGS. 7 and 8. In this simplified embodiment the same aerodynamic feeding and rotor spinning function and apparatus are utilized and are designated in the drawings by the same reference numerals, but the initial feeding and the electrostatic field arrangements are modified. Thus, no enclosing and enclosed combination of electrodes is used to provide the electrostatic field and no zone of increased field intensity is produced. Rather, the fibers F are fed directly from a pair of drafting rolls 100, which are preferably the last pair of a series of drafting rolls on a drawing frame that draws a sliver S down into separate fibers through the progressive action of the series of drafting rolls.

As the fibers leave the nip of the drafting rollers 100, they enter an electrostatic field E produced by an electrical potential imposed between the rollers and the entrance 101 of a tube 102 that forms an extension of the aforementioned passageway 45 through which fibers F are drawn by suction to the rotor 32 for forming into the spun yarn Y. In a manner similar to that of the embodiment of FIGS. 1–6, the electrostatic field serves to open, straighten, and generally linearly orient the fibers F as they leave the drafting rollers 100, with the results being enhanced by the suction drawing the fibers into the tube entrance 101. The electrostatic field E and the suction also combine to converge the fibers from a flat sliver width to a generally axial disposition within the tube 102 as illustrated in FIG. 8.

Obviously, it is to be understood that various other modifications and variations may be resorted to within the skill of the art without departing from the substance or scope of the present invention, which is intended to be limited only by the appended claims and equivalents thereof.

We claim:

1. An open-end spinning process for producing spun yarn from staple fibers using an electrostatic field and a spinning rotor comprising:

(a) continuously feeding staple fibers to an electrostatic field, (b) electrostatically straightening and generally linearly orienting said fibers in said field, (c) withdrawing said fibers aerodynamically from said field in generally linearly oriented and straightened disposition and feeding said withdrawn fibers aerodynamically onto the surface of said spinning rotor in generally linearly oriented and straightened disposition, (d) rotating said rotor to cause said fibers thereon to be centrifugally gathered and combined to form a strand of fibers, and (e) continuously withdrawing and twisting said fiber strand from said rotor to form a spun yarn.

2. An open-end spinning process according to claim 1 and characterized further in that said electrostatically straightening and orienting said fibers comprises electrostatically migrating said fibers in said field to a zone of increased field intensity in which said fibers are generally linearly oriented and straightened.

3. An open-end spinning process according to claim 1 and characterized further in that said aerodynamic withdrawing of fibers from said field is performed substantially co-linearly with said linear orientation of said fibers in said field.

4. An open-end spinning process according to claim 1 and characterized further in that said aerodynamic feeding of said fibers onto said rotor surface includes increasing the velocity of said fibers from said field to said rotor surface to enhance the general linearly oriented and straightened disposition of said feeding fibers.

5. An open-end spinning process according to claim 1 and characterized further in that said rotating of said rotor includes rotating said rotor at a fiber receiving surface velocity greater than the velocity at which said fibers are fed thereonto so as to maintain and further enhance said general linear orientation and straightening of said fibers.

6. An open-end spinning process according to claim 1 and characterized further in that said aerodynamic withdrawing of said fibers from said field and said aerodynamic feeding of said fibers onto said rotor surface includes applying suction to create a moving carrying airstream to effect said withdrawing and feeding.

7. An open-end spinning process according to claim 6 and characterized further in that said aerodynamic withdrawing and feeding includes gradually narrowing the cross-sectional area of said moving airstream of fibers to increase the velocity thereof.

8. An open-end spinning process according to claim 6 and characterized further in that air is drawn to said rotor by said aerodynamic feeding, and said rotating of said rotor effects generally circumferential circulation of air so as to maintain and further enhance the general linear orientation and straightening of said fibers as they are fed onto said rotor surface, said circulating air gradually escaping over the rim of said rotor.

9. An open-end spinning process according to claim 1 in which said spinning rotor has an acutely inclined circumferential wall having an inner surface and characterized further in that said feeding of said fibers to said rotor includes depositing said fibers onto said inner surface of said inclined wall, and in that said rotating of said rotor causes said fibers to gradually centrifugally progress along said inner surface in combining to form said strand.

10. An open-end spinning process according to claim 9 and characterized further in that said feeding includes depositing said fibers substantially tangentially on said inner surface of said inclined rotor wall.

11. An open-end spinning process according to claim 1 and characterized further in that said feeding staple fibers to said electrostatic field includes feeding a fiber strand to an opening device, separating said fiber strand with said opening device into individual fibers and feeding said individual fibers to said electrostatic field.

12. An open-end spinning process according to claim 11 and characterized further by applying suction to effect said feeding of said individual fibers from said opening device to said electrostatic field.

13. An open-end spinning process according to claim 1 and characterized further by collecting at a spacing from said zone fly and other waste material that enter said electrostatic field.

14. Apparatus for producing an open-end spun yarn from staple fibers comprising:

(a) means for creating an electrostatic field, (b) means for continuously feeding staple fibers to said electrostatic field for electrostatically opening, straightening and linearly aligning said fibers in said zone, (c) a body disposed adjacent said field and having a rotor chamber therein, (d) a spinning rotor rotatably disposed in said chamber, (e) a passageway in said body extending from said field to said chamber for feeding said fibers from said field onto the surface of said rotor, (f) suction means for drawing air through said chamber and passageway for withdrawing said straightened and aligned fibers from said field and feeding said fibers into and through said passageway onto said rotor surface, (g) means for rotating said rotor for centrifugally straightening, aligning, and combining said fibers deposited onto the surface thereof so as to form a strand, and (h) means for continuously withdrawing said fiber strand in twisted form from said rotor to form a spun yarn.

15. Apparatus for producing an open-end spun yarn according to claim 14 and characterized further in that said electrostatic field has a zone in increased field intensity and said continuously feeding means feeds fibers to said field for electrostatic migration of the fibers by said electrostatic field to said zone for electrostatically opening, straightening and linearly aligning fibers in said zone.

16. Apparatus for producing an open-end spun yarn according to claim 15 and characterized further by means for collecting at a spacing from said linear zone of increased field intensity fly and other waste material that enter said electrostatic field.

17. Apparatus for producing an open-end spun yarn according to claim 14 and characterized further in that said passageway adjacent said field is colinear with said linearly aligned fibers in said zone.

18. Apparatus according to claim 14 and characterized further in that said passageway is substantially linear with its cross sectional area gradually decreasing longitudinally from sai field to said chamber.

19. Apparatus according to claim 14 and characterized further in that said passageway is oriented generally tangentially to said rotor.

20. Apparatus according to claim 14 and characterized further in that said rotor includes an acutely inclined circumferential wall having an inner surface for receipt of fibers thereon and along which said fibers gradually progress centrifugally and combine to form a strand.

21. Apparatus according to claim 20 and characterized further in that said body includes a cylindrical portion projecting into said rotor chamber adjacent said inner surface of said rotor wall and having a circular cross-sectional area slightly smaller than the adjacent circular area of said rotor wall, said rotor wall encircling said projecting portion with a small airspace therebetween.

22. Apparatus according to claim 21 and characterized further in that said passageway extends in said cylindrical projecting portion and opening on the cylindrical surface thereof adjacent the surface of said rotor wall for tangential deposit of fibers from said passageway onto the surface of said rotor wall for centrifugal progression along said wall to form said fiber strand.

23. Apparatus for producing an open-end spun yarn according to claim 14 and characterized further in that said means for continuously feeding staple fibers to said electrostatic field includes a housing disposed adjacent said electrostatic field, a passageway within said housing having at one end thereof a first opening located on the surface of said housing for feeding of a fiber strand therethrough into said housing and having at the other end thereof a second opening communicating with said electrostatic field for feeding of individual fibers therethrough into said electrostatic field, and means disposed within said housing passageway for separating said fiber strand into individual fibers and dispensing said individual fibers into said housing passageway in the direction of said second opening.

24. Apparatus for producing an open-end spun yarn according to claim 14 and characterized further in that said means for continuously feeding staple fibers to said electrostatic field includes suction means for drawing said individual fibers into said electrostatic field.

* * * * *

UNITED STATES PATENT OFFICE

CERTIFICATE OF CORRECTION

Patent No. 4,170,866 Dated Oct. 16, 1979

Inventor(s) Frank A. Aschenbrenner et al

It is certified that error appears in the above-identified patent and that said Letters Patent are hereby corrected as shown below:

Column 3, line 58, delete "suction" and insert --taken--.
Column 6, line 15, delete "suctin" and insert --suction--.
Column 10, line 40, delete "sai" and insert --said--.

Signed and Sealed this

*Twenty-seventh* Day of *May 1980*

[SEAL]

*Attest:*

SIDNEY A. DIAMOND

*Attesting Officer* *Commissioner of Patents and Trademarks*